United States Patent [19]

Sneckenberger

[11] 3,982,605

[45] Sept. 28, 1976

[54] NOZZLE NOISE SILENCER

[75] Inventor: John E. Sneckenberger, Morgantown, W. Va.

[73] Assignee: The Carborundum Company, Niagara Falls, N.Y.

[22] Filed: May 5, 1975

[21] Appl. No.: 574,475

[52] U.S. Cl. ..... 181/47 B; 181/36 A; 51/11; 239/589; 239/DIG. 21

[51] Int. Cl.[2] ..... F01N 1/00

[58] Field of Search ..... 181/35 R, 36 R, 36 A, 181/36 B, 41, 47 R, 47 B, 72; 15/326; 51/11; 239/591, DIG. 21, 589

[56] References Cited

UNITED STATES PATENTS 2,543,517 2/1951 Anderson ..... 239/591 UX 3,628,627 12/1971 Arnold ..... 181/36 R

*Primary Examiner*—John Gonzales

*Attorney, Agent, or Firm*—David E. Dougherty; William H. Holt

[57] ABSTRACT

A silencer device for attachment to a nozzle, or a combined nozzle and silencer, are provided for reducing the noise generated by compressed air or a compressed air-particulate mixture exiting from conventional nozzles of the type used for air blasting, sandblasting, or peening operations. The silencer has a bore of substantially constant diameter which is, within limits, larger than the nozzle bore for which the silencer is designed.

5 Claims, 3 Drawing Figures

NOZZLE NOISE SILENCER

BACKGROUND OF THE INVENTION

Silencers for air guns used in the surface treatment of articles by abrasive blasting are known in the prior art, as is exemplified by U.S. Pat. No. 3,628,627, this patent having been granted on Dec. 21, 1971.

SUMMARY OF THE INVENTION

The present invention relates to a silencer for blast nozzles to reduce the noise created by a discharge of compressed air or a discharge of a compressed air-particulate mixture in order to overcome at least two problems presently existing in the art, namely, (1) the unacceptable high level of noise which is either injurious to workers or requires the use of silentproofing equipment, and (2) the somewhat related problem of the upper limit of pressures now in common use in industry because of the even greater amount of noise associated with higher pressures. Thus, the present invention contemplates either the reduction of noise at present air pressure levels or the use of higher pressures without a corresponding increase in the noise level.

More particularly, the present invention relates to the provision of a silencer for a nozzle, or a combined nozzle and silencer, wherein the silencer is comprised of a body member having a silencer bore diameter which is substantially constant throughout its length and is larger than the nozzle exit diameter within a range between approximately 110 percent and 350 percent.

A further object of the invention is to provide a silencer device of the type described above wherein the bore of the silencer is of a length between 60 percent and 200 percent of the length of the nozzle bore.

A still further object of the invention is the provision of a combined nozzle and silencer which may be, alternatively, formed in an integral one-piece construction or as separate members which are adapted to be connected together.

REFERENCE TO THE DRAWINGS

DETAILED DESCRIPTION OF THE INVENTION

Figure 1:
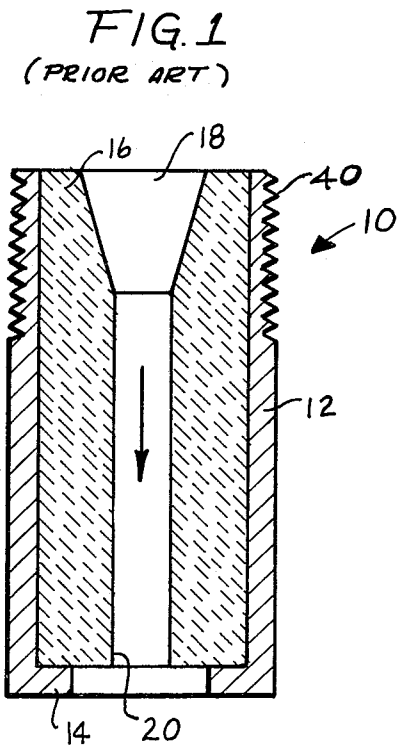
FIG. 1 (PRIOR ART)
FIG. 1 is a cross-section of a conventional blast nozzle which is known in the prior art.

A known type of blast nozzle, generally indicated by the numeral 10, is shown in FIG. 1 as being comprised of an annular jacket 12 which is usually cylindrical about its central axis and has inturned end portions 14 for encapsulating a wear-resistant ceramic liner 16. Liner 16 may be formed of such materials as tungsten carbide or boron cabide, and is shown as including a tapered section 18 which converges to a constant diameter nozzle portion 2. Nozzles 10 are well known and are used extensively in industry for such operations as air blasting, sandblasting, peening, etc. These nozzles are known to create a large amount of noise, in excess of 100 dBA, when used with compressed air at pressure ranging up to, or exceeding, 100 psi., a conventional operating pressure being approximately 80 psi.

Figure 2:
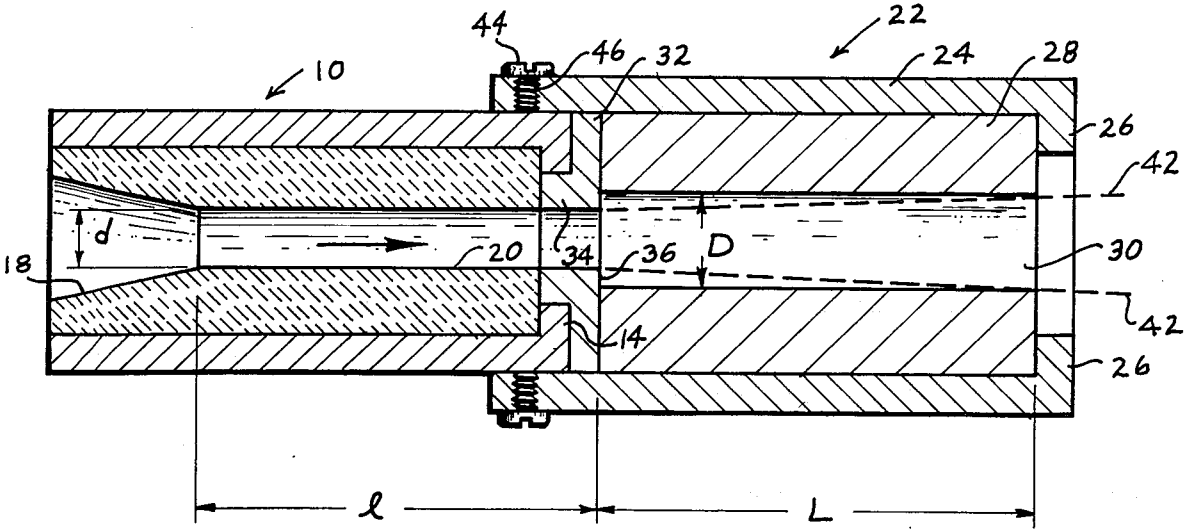
FIG. 2 is a sectional view of a combined nozzle and silencer wherein the nozzle portion and silencer portion are of separate construction and connected together in an operative manner.

As is shown in FIG. 2, a novel silencer device, generally indicated by the numeral 22, includes a jacket 24 which may be cylindrical, as shown, or may be of any other shape, and includes inturned end portions 26 for encapsulating therein a body member 28 which is provided with a nozzle bore 30, the bore 30 being of a substantially constant diameter D and having a nozzle bore length L. As an expedient for adapting the silencer 22 to a conventional nozzle 10, there is provided a washer member 32 having a reduced portion 34 which is made to fit within the inturned end portions 14 such that there is a right-angle transition 36 at the planar interface of the nozzle bore 20 and silencer bore 30. For purposes of this disclosure, the nozzle bore 20 is shown as having a constant diameter *d* and a length *l*, the length being measured from the smallest diameter of the tapered portion 18 to the exit end of the nozzle bore 20 including the length of the washer member 32.

In operation the nozzle 10 is usually connected by its threaded end portion 40 to a hose or pipe (not shown) which carries high pressure air, or high pressure air and particulate matter such as abrasive grit, sand, or peening particles. As the air, or air and particulate mixture, enters the tapered portion 18, the fluid is compressed and its velocity is increased until it exits from the exit end of the nozzle and then a slight expansion occurs within the silencer bore 30. As will be apparent to those skilled in the art, the expanded flow is illustrated diagrammatically by the broken lines 42. While not illustrated as such, it is to be understood that when using an air-particulate mixture it may be preferable to form the body member 28 eithe totally or partially of a wear-resistant ceramic material such as that used for the liner 20.

Silencer 22 must, necessarily, be fixedly attached to the nozzle 10, one suitable means for attachment being shown as comprised of a set screw 44 fastened within a threaded bore 46 in the jacket 24.

Figure 3:
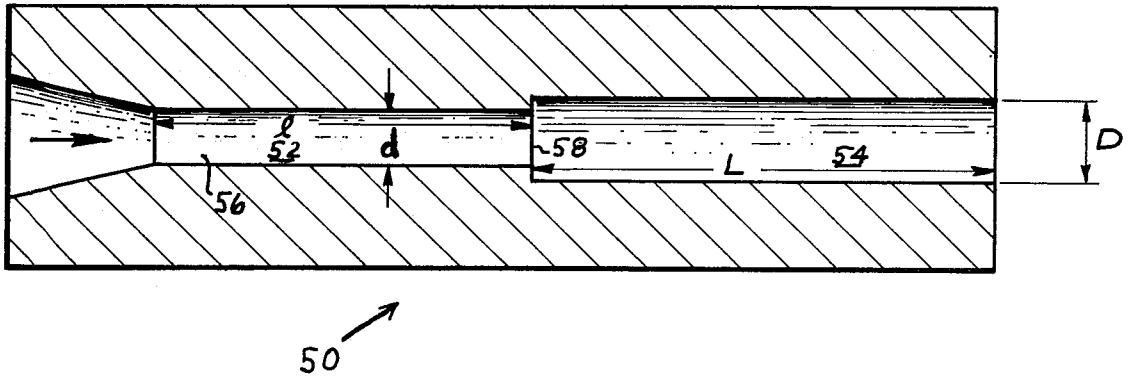
FIG. 3 is a sectional view, similar to FIG. 2, wherein the nozzle and silencer are formed as an integral one-piece unit.

FIG. 3 illustrates an integral one-piece combined nozzle and silencer device, generally indicated by the numeral 50, the device 50 including a nozzle portion 52 and a silencer portion 54. Nozzle portion 52 includes a nozzle bore 56 having a substantially constant diameter d and a nozzle length l, while the silencer portion 54 is illustrated as having a substantially constant diameter D and a nozzle length L. In the same manner as described heretofore with regard to the embodiment of FIG. 2, the interface between the exit end of the nozzle bore 56 and the entrance of the silencer bore 54 is planar as is shown at 58.

It is to be understood that the device 50 may be constructed of various types of materials including plastics, when used solely for compressed air, or may be formed of hardened metals or ceramic materials when the device 50 is used with an air-particulate mixture.

It is believed that there is a somewhat critical relationship between the silencer bore diameter D and the nozzle bore diameter *d*, and a somewhat less critical relationship between the silencer bore length L and the nozzle bore length *l*, and a somewhat critical relationship between these parameters and the particular operating pressures. Two examples of the interrelationship between the various parameters will be described hereinafter.

One standard nozzle, having $d = 3/8$inch and $l = 2.5$ inches registered a sound level of 95.5 dBA with only compressed air at 80 psi. One silencer, having D = 5/8 inch and $L = 2.7$ inches reduced the sound level by 8.5 dBA to a reading of 87 dBA.

A different standard nozzle, having $d = 5/16$ and $l = 2.5$ inches registered a sound level of 107.5 dBA using compressed air at 50 psi. A second silencer, having $D = 39/64$ inch and $L = 3$ inches reduced the sound level by 19 dBA to a reading of 88.5 dBA.

While the invention has been described herein with references to various preferred embodiments and specific examples, it is to be understood that various changes and modifications may be made by those skilled in the art without departing from the spirit and scope of the invention as defined in the following claimed subject matter.

I claim:

1. A nozzle noise silencer device for reducing noise created by a flow of fluid from a nozzle which includes a nozzle bore having a length $l$ and a nozzle exit diameter $d$; said silencer device comprising a body member having a silencer bore extending therethrough and having a silencer bore length L and a silencer bore diameter D, the improvement comprising said silencer bore diameter D being substantially constant throughout its entire length and being larger than said nozle exit diameter $d$ within a range between 110 percent and 350 percent.

2. A silencer device as defined in claim 1 wherein the silencer bore length L is between 60 percent and 200 percent of the nozzle bore length $l$.

3. A combined nozzle and silencer device for reducing sound created by fluid flow therethrough, said device comprising a nozzle portion and a silencer portion, said nozzle portion including a nozzle bore having a nozzle bore length $l$ and an exit bore diameter $d$, said silencer portion including a silencer bore having a silencer bore length L and a silencer bore diameter D; the improvement comprising said silencer bore diameter D being substantially constant throughout its entire length and being larger than said nozzle exit diameter $d$ within a range between 110 percent and 350 percent.

4. A combined nozzle and silencer device as defined in claim 3 wherein said nozzle portion and said silencer portion are of an integral one-piece construction.

5. A combined nozzle and silencer device as defined in claim 3 wherein said nozzle portion and said silencer portion are of separate construction, and means are provided for connecting said nozzle portion of said silencer portion.

* * * * *